US011084152B2

(12) United States Patent
Martinez

(10) Patent No.: US 11,084,152 B2
(45) Date of Patent: Aug. 10, 2021

(54) MECHANICAL DEVICE SELF-CENTERING GEAR EXTRACTOR

(71) Applicant: Julio Sampedro Martinez, Vitoria-Gasteiz (ES)

(72) Inventor: Julio Sampedro Martinez, Vitoria-Gasteiz (ES)

( * ) Notice: Subject to any disclaimer, the term of this patent is extended or adjusted under 35 U.S.C. 154(b) by 224 days.

(21) Appl. No.: 16/397,537

(22) Filed: Apr. 29, 2019

(65) Prior Publication Data

US 2020/0338705 A1 Oct. 29, 2020

(51) Int. Cl.
*B27B 27/00* (2006.01)
*B25B 27/02* (2006.01)

(52) U.S. Cl.
CPC ..... *B25B 27/026* (2013.01); *B25B 27/023* (2013.01)

(58) Field of Classification Search
CPC .. B23Q 3/00; B23Q 3/06; B23Q 3/082; B25B 27/026; B25B 27/023; B25B 5/00; B25B 5/04; B25B 5/10; B25B 27/06; B25B 27/064; B23P 19/00; B23P 19/027
See application file for complete search history.

(56) References Cited

U.S. PATENT DOCUMENTS 5,159,743 A 11/1992 Somerville
6,895,646 B1 * 5/2005 Houg ..... B25B 27/026 29/252

FOREIGN PATENT DOCUMENTS

| | | | |
|---|---|---|---|
| CN | 2 501 647 | Y | 7/2002 |
| EP | 0 575 170 | A1 | 12/1993 |
| ES | 2 042 353 | A1 | 12/1993 |
| ES | 2 113 250 | A1 | 4/1998 |
| ES | 1 187 563 | U | 7/2017 |
| WO | 2016/135367 | A1 | 9/2016 |

OTHER PUBLICATIONS

ISR; European Patent Office; NL Aug. 7, 2018.

* cited by examiner

*Primary Examiner* — Lee D Wilson
(74) *Attorney, Agent, or Firm* — Patshegen IP LLC; Moshe Pinchas

(57) ABSTRACT

A mechanical self-centring gear extractor device allows the use of a hydraulic cylinder to provide the extraction force, while having self-centring that prevents the accidental opening of the claws, increasing safety during extraction. The extractor includes a first spindle and pulling claws articulated and indirectly coupled to the first spindle, so they can move along it while being supported by it; including a centring device for the claws consisting of connecting rods articulated at one of their ends to intermediate regions of the claws and at the opposite end to a support whose position can be adjusted coaxially along the upper part of the first spindle, including a second spindle coaxial with the first spindle and independent of it in rotation and secured to it in stroke, and including an external thread to thread a handle joined in stroke and independent in rotation of that position adjustable support.

8 Claims, 2 Drawing Sheets

MECHANICAL DEVICE SELF-CENTERING GEAR EXTRACTOR

BACKGROUND OF THE INVENTION

Field of the Invention

The present invention is for a mechanical self-centring gear extractor device, usable for the extraction of plates, gears and the like from the shafts they are on.

Description of the Related Art

Currently, mechanical extractors are known that include a first spindle that rests it tip on the head of a shaft, and articulated pulling claws indirectly coupled to the first spindle to be able to move along its length and to be supported by it and moving away from the tip and thus extracting an element mounted on that shaft when the claws are coupled to its rear face (opposite the head of the shaft).

These claws are indirectly coupled to the first spindle by the means of joints that allow them, on the one hand, to open and adapt themselves to pieces to be extracted of different sizes or diameters, and, on the other hand, to open enough that the claws can cover the outer contour of those pieces to reach and then close onto their back face.

Some examples are described in the following documents:

ES 2042353, showing a mechanical extractor where the claws are coupled to the spindle through a nut onto which the spindle is screwed off-centre. The nut has radial arms onto which, through a support, the claws are articulated. It has the disadvantage that it does not produce a reliable centring.

ES 2113250, which shows an extractor in which each claw includes a radial connecting rod that links its movement to eccentric points on a collar that is mounted with the ability to rotate and to move axially relative to the spindle, thus aligning the axis of the spindle with the axis of the piece to be extracted.

The applicant, moreover, is the owner of patent document PCT/ES2016/070182 for a self-centring part extractor, which includes said first spindle that rest its tip on the head of a shaft and the articulated pulling claws, coupled to the first spindle so as to move along it, also including a centring of the claws which includes rods articulated at one end to intermediate parts of the claws and at the opposite end to a support whose position is coaxially adjustable (in stroke) along the upper part (consisting of the part beyond the claws) of the first spindle, so that by adjusting the distance of that support relative to the articulations of the claws—because of the connecting rods—a fixed and uniform opening of them is achieved, and therefore its centring relative to the element to be extracted and its shaft and the impossibility of accidental opening during extraction. To adjust the position of the support along the first spindle, this document has a second tubular spindle coaxial with the first spindle and independent of it in rotation and secured to it in stroke (which allows the independent rotation of both, but their stroke is joint) and externally threaded, so that a handle can be threaded onto it, that is fixed to it in stroke, but can rotate independently (for example by means of projections and circumferential channels) of that position adjustable support.

On the other hand, extractors are also known where the pulling claws are adjustably coupled in stroke with the first spindle through a hollow piston hydraulic cylinder, so that the suitably internally threaded face of the piston receives the thread of the first spindle, supporting the cylinder sleeve on the threaded support or nut to which the claws are articulated and which in turn is threaded onto the spindle. This allows the extraction force to be provided hydraulically, typically by a manual pump fitted to the cylinder, and to improve the extraction capacity. However, there is no known extractor that combines self-centring and the cylinder arrangement, which raises the problem that, since the cylinder provides a great deal of force during the extraction, it can be dangerous if the claws slip or if the part being extracted is loosened suddenly from the shaft on which it is fitted.

SUMMARY OF THE INVENTION

The mechanical self-centring gear extractor device of the invention has a configuration that allows the use of a hydraulic cylinder to provide the extraction force, while having self-centring that prevents the accidental opening of the claws, increasing safety during extraction.

The extractor of the invention is of the type including a first spindle and pulling claws articulated and indirectly coupled to the first spindle, so they can move along it while being supported by it; including a centring device for the claws consisting of connecting rods articulated at one of their ends to intermediate regions of the claws and at the opposite end to a support whose position can be adjusted coaxially along the upper part of the first spindle, including a second spindle coaxial with the first spindle and independent of it in rotation and secured to it in stroke, and including an external thread to thread a handle joined in stroke and independent in rotation of that position adjustable support.

With this basic configuration, and according to the invention, the extractor further includes:

- a hollow piston hydraulic cylinder including an internal thread into which the first spindle is threaded; and
- where that cylinder is arranged in the space between the connecting rods, resting on the position adjustable support to produce its movement with the extracting grip of the claws, grip that is transmitted to them through the rods.

Thanks to the first characteristic, the claws are coupled to the first spindle coaxially through the second spindle and in stroke through the cylinder, so that by properly regulating the position of the tip of the first spindle on the head of the shaft and the closing of the claws thanks to the handle that threads onto the second spindle, the cylinder piston stroke is reduced to a minimum, it need only be enough to loosen the element to be extracted from the shaft. Furthermore, as an unexpected effect, since only a very short cylinder is needed thanks to the reduced stroke of the piston, the cylinder fits in the space between the connecting rods, being placed in this space according to the second indicated characteristic, which allows the length of the claws to be reduced in comparison with other hollow piston cylinder extractors, where the cylinder necessarily is placed inside the claws and the length it takes up along the spindle is increased by a greater length of the claws. This invention results in a highly compact self-centring piston extractor with a saving in material and costs.

DETAILED DESCRIPTION OF THE SEVERAL EMBODIMENTS

Figure 1:
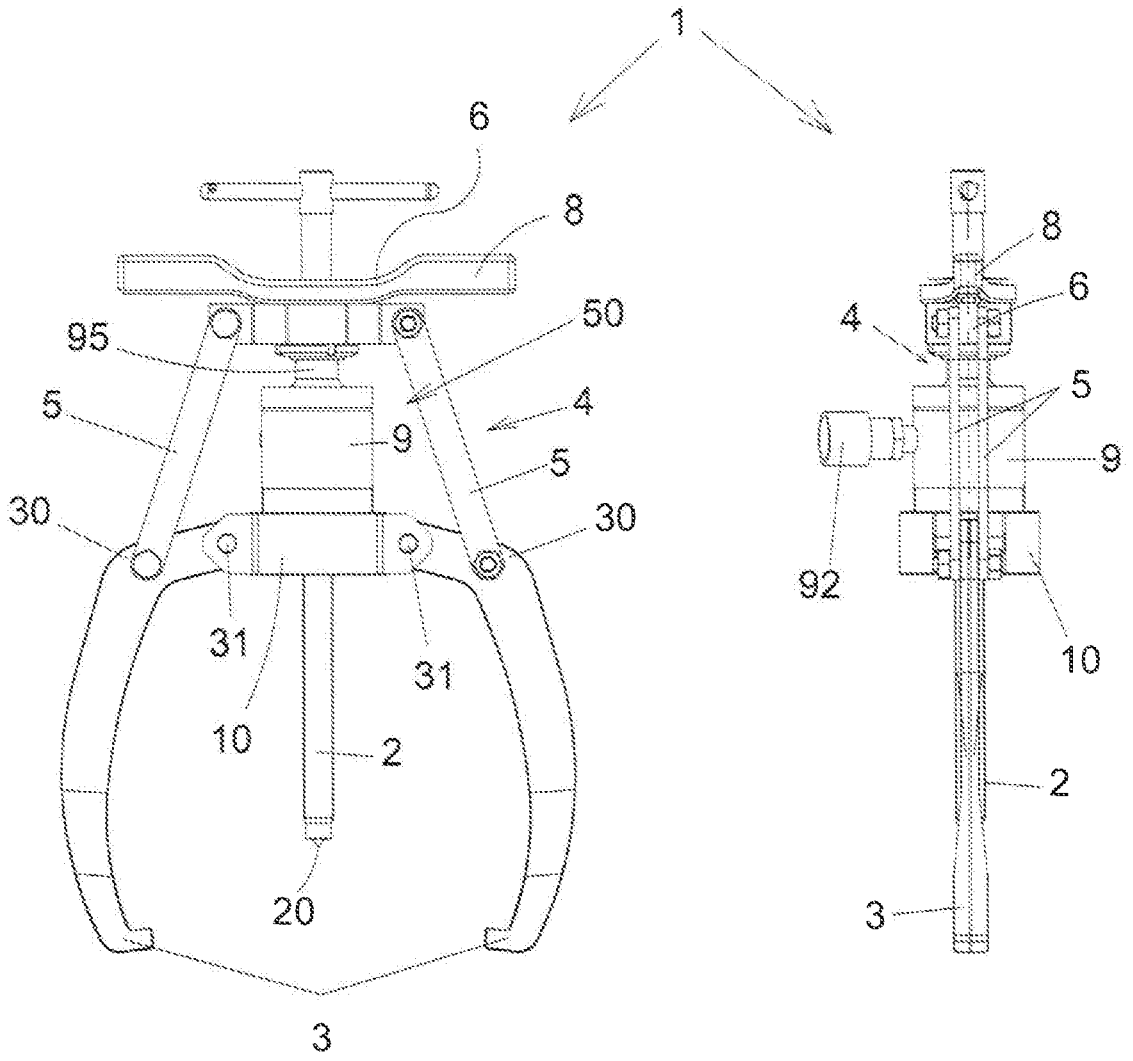
FIG. 1 shows an elevation and a side view of the extractor of the invention.
Figure 2:
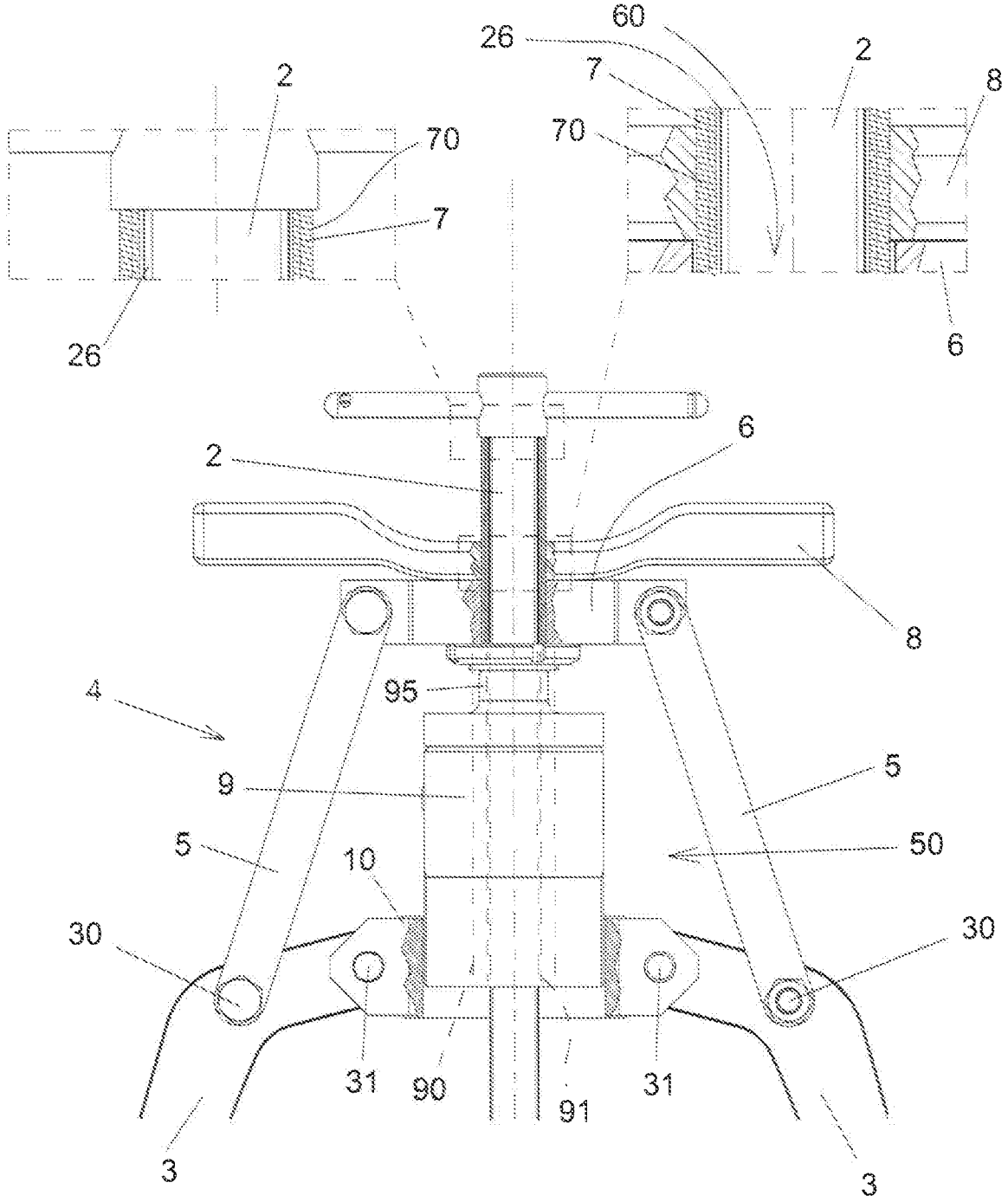
FIG. 2 shows a partially sectioned detail of the elevation of FIG. 1 as well as two parts of the detail enlarged.

The mechanical self-centring gear extractor device (1) of the invention is of the type including a first spindle (2) (with its corresponding external thread (26)) and articulated claws (3) hinged and indirectly coupled to the first spindle (2) so they can move along it and be supported by it; including a centring device (4) for the claws (3) including connecting rods (5) articulated at one of their ends to intermediate parts of the claws (3) and at the opposite end to a support (6) whose position can be adjusted coaxially in stroke along the length of the upper part of the first spindle (2); including a second tubular spindle (7) (see FIG. 2) coaxial with the first spindle (2) and independent of it in rotation and secured to it in stroke, and including an external thread (70) to thread a handle (8) onto, which is fixed in stroke but can rotate independently of that support (6), including, according to the invention:

- a hollow piston (90) hydraulic cylinder (9) including an internal thread (91) into which the first spindle is threaded; and
- where that cylinder (9) is located in the space (50) existing between the connecting rods (5) resting on the adjustable position support (6) to produce its movement with extracting grip from the claws (3).

Preferably, the support (6) comprises a ring, or a plate provided with a central hole (60) (see FIG. 2) with a slightly larger diameter than the external thread (70) of the second spindle (7), which allows the support (6) to move along the second spindle (70) while being fixed in rotation by the connecting rods (5) and its position in stroke being set by the handle (8).

It is also expected that the claws (3) can be held by means of some end joints (31) on a collar (10) that surrounds the cylinder (9) to allow the pulling movement of the claws (3) when the cylinder (9) passes through that collar (10) when the cylinder (9) reaches the area of that collar, which will occur in most cases if one does not want to lengthen the connecting rods (6) and the first spindle (2) when manufacturing the extractor. Furthermore, this produces a guiding of the movement of the collar (10) by means of the shape of the cylinder (9).

Very preferably, the cylinder (9) is either directly supported on the adjustable position support (6), or via a small base (95). A direct support gives a greater possible cylinder length.

Further, it is expected that the first spindle (2) can include a projection (20) for centring at its tip to improve its support on the head or end, not shown, of the shaft.

As for the cylinder (9), it includes a connector (92) for the connection of an external hydraulic pump, not shown.

Indicate that the claws (3) are equally spaced angularly, covering 360 degrees (and that there are at least two claws (3)).

Finally, indicate that the rods (5) are ideally articulated in intermediate areas of the claws (3) which include an elbow (30), since this way the centring force of the rods (5) is better controlled.

The nature of the invention and the manner in which it is embodied having been sufficiently described, it should be noted that the foregoing arrangements shown in the accompanying drawings may have their details changed as long as they do not alter the fundamental principle.

What is claimed is:

1. A mechanical self-centring gear extractor device (1); of the type including a first spindle (2) and articulated claws (3) hinged and indirectly coupled to the first spindle (2) including a centring device (4) for the claws (3) including connecting rods (5) articulated at one of their ends to intermediate parts of the claws (3) and at the opposite end to a support (6) whose position can be adjusted coaxially in stroke along the length of the upper part of the first spindle (2); including a second tubular spindle (7) coaxial with the first spindle (2) and configured for rotating independently of the first spindle, and including an external thread (70) to thread a handle (8) onto which is fixed in stroke but can rotate independently of that support (6);

wherein the device further includes:

- a hollow piston (90) hydraulic cylinder (9) including an internal thread (91) into which the first spindle is threaded; and
- where that cylinder (9) is located in the space (50) existing between the connecting rods (5) resting on the adjustable position support (6) to produce its movement with extracting grip from the claws (3).

2. The mechanical self-centring gear extractor device (1) according to claim 1, wherein the support (6) comprises a plate provided with a central hole of slightly larger diameter than the external thread (70) of the second spindle.

3. The mechanical self-centring gear extractor device (1) according to claim 1, wherein the claws (3) are held by means of end joints (31) in a collar (10) that sits around the cylinder (9) to allow the pulling movement of the claws (3) when the cylinder (9) crosses that collar (10).

4. The mechanical self-centring gear extractor device (1) according to claim 1, wherein the cylinder (9) is supported on the adjustable position support (6) either directly or via a base (95).

5. The mechanical self-centring gear extractor device (1) according to claim 1, wherein a tip of the first spindle (2) includes a centring projection (20).

6. The mechanical self-centring gear extractor device (1) according to claim 1, wherein the cylinder (9) includes a connector (92) for connecting an external hydraulic pump.

7. The mechanical self-centring gear extractor device (1) according to claim 1, wherein the claws (3) are equally spaced angularly over 360 degrees.

8. The mechanical self-centring gear extractor device (1) according to claim 1, wherein the rods (5) are articulated in intermediate areas of the claws (3) where there is a bend (30).

* * * * *